US008267342B2

(12) United States Patent
Lohia

(10) Patent No.: US 8,267,342 B2
(45) Date of Patent: Sep. 18, 2012

(54) DEVICE FOR INTRODUCING YARN TO THE GRASPING DEVICE OF AN AUTOMATIC TURRET TYPE WINDER

(75) Inventor: Amit Kumar Lohia, Kanpur (IN)

(73) Assignee: Lohia Starlinger Limited, Kanpur (IN)

( * ) Notice: Subject to any disclaimer, the term of this patent is extended or adjusted under 35 U.S.C. 154(b) by 190 days.

(21) Appl. No.: 12/449,702

(22) PCT Filed: Sep. 4, 2008

(86) PCT No.: PCT/IN2008/000566

§ 371 (c)(1),
(2), (4) Date: Dec. 17, 2009

(87) PCT Pub. No.: WO2009/031163

PCT Pub. Date: Mar. 12, 2009

(65) Prior Publication Data

US 2010/0264247 A1 Oct. 21, 2010

(30) Foreign Application Priority Data

Sep. 7, 2007 (IN) ..... 1896/DEL/2007

(51) Int. Cl.
*B65H 67/048* (2006.01)

(52) U.S. Cl. ..... 242/474.7; 242/475; 242/476.5

(58) Field of Classification Search ..... 242/474.3, 242/474.4, 474.5, 474.6, 474.7, 474.8, 474.9, 242/475, 476.1, 476.2, 476.3, 476.4, 476.5, 242/476.6, 615, 615.3, 157 R, 157.1
See application file for complete search history.

(56) References Cited

U.S. PATENT DOCUMENTS

| | | | | |
|---|---|---|---|---|
| 2,130,121 | A * | 9/1938 | Dunleavy | 242/477.1 |
| 2,296,339 | A * | 9/1942 | Daniels | 242/474.8 |
| 2,620,999 | A * | 12/1952 | Carter et al. | 242/157 R |
| 3,857,522 | A | 12/1974 | Fink | |
| 3,903,681 | A * | 9/1975 | Bous | 57/313 |
| 5,344,090 | A | 9/1994 | Nakai et al. | |
| 6,543,714 | B1 * | 4/2003 | Ehmann et al. | 242/474.8 |

FOREIGN PATENT DOCUMENTS

DE 2364158 6/1975

OTHER PUBLICATIONS

Int'l Search Report, Jan. 29, 2009, Lohia Starlinger Limited.

* cited by examiner

*Primary Examiner* — William E Dondero
(74) *Attorney, Agent, or Firm* — McDonald Hopkins LLC

(57) ABSTRACT

The present invention relates to a traverse guide of a novel design and construction and a transfer link that together transfer the advancing yarn to a grasping device and, once it has been grasped, back to the traverse guide. The transfer link shifts the advancing yarn from the traverse guide while still positioning the yarn within a virtual controlled zone within which the yarn stays until it is grasped by the grasping device, where after, during the return stroke of transfer link, the advancing yarn is placed back into the traverse guide so that yarn can be uniformly wound on the bobbin.

17 Claims, 7 Drawing Sheets

Figure 1:
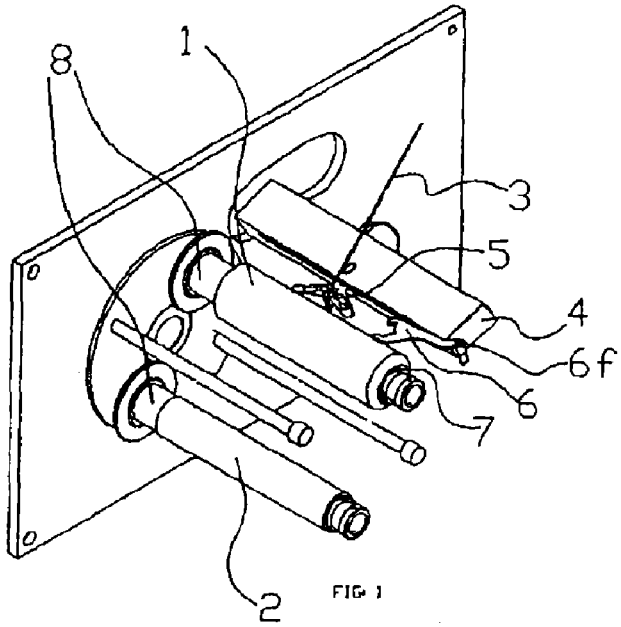
FIG. 1 Prior Art

DEVICE FOR INTRODUCING YARN TO THE GRASPING DEVICE OF AN AUTOMATIC TURRET TYPE WINDER

The present application is a U.S. National Stage Application of International Patent Application Ser. No. PCT/IN2008/000566 filed on Sep. 4, 2008, which claims priority to Indian Patent Application No. 1896/DEL/2007 filed on Sep. 7, 2007.

FIELD OF THE INVENTION

The present invention relates to automatic turret type winders and more particularly to devices used in transfer of continuous advancing yarn to grasping device during the bobbin changeover operation.

BACKGROUND OF THE INVENTION

In the following description, the term "yarn" is intended to also include the threads, tapes, profile tapes, fibrillated tapes and slit-film bands of various linear mass density, diameter, width and thickness. The term "bobbin" is intended to include any metallic or non-metallic tubes on which the yarn is wound to form a suitable package. The term 'yarn' is also used to describe yarn with multiple threads or ends that a single winder might receive.

Automatic turret type winders are used in production or take-up process of continuously advancing yarn, for example, in yarn extrusion machines or in rewinding process for making plurality of small size yarn packages from a large yarn package. In general, the turret type automatic winders are positioned side by side in the horizontal direction and stack one above the other in vertical direction. The number of winding positions is exemplary both in horizontal row and vertical row.

The yarn transfer operation is important in the automatic yarn winding operation. If the yarn is not transferred in the first attempt, the continuously advancing yarn gets wasted until it is rethreaded. Worse still, the continuously advancing yarn, if not controlled properly in case it fails to transfer onto the empty bobbin, may interfere with the other yarn winders on the same machine and cause the entire machinery to stop which results in a huge amount of wastage, machine downtime and economic loss. In the worst situations, some parts of the machinery may get damaged.

In automatic turret type winders, a continuously advancing yarn is generally wound on an initially empty bobbin to form a suitable yarn package. When the pre-determined package size (length/diameter/time) is achieved on a bobbin installed on one of the bobbin holders, generally known as a spindle, the continuously advancing yarn is transferred by an automatic transfer device to an empty bobbin installed on another spindle to make a new yarn package without interrupting the winding operation. During the bobbin changeover operation, the empty bobbin is positioned in the path of the advancing yarn by rotating the turret. The continuously advancing yarn is then guided onto a yarn grasping device or a catching device by axially shifting or displacing the bobbin spindle or the traversing unit, such that the yarn is clamped at grasping device and then laid across the empty bobbin. Simultaneously, the yarn connecting the bobbin under winding and the full bobbin is severed.

While most of these known devices for transferring the yarn to the grasping device function satisfactorily, some of them, such as the one disclosed in EP 03725171 involves complex mechanisms of achieving yarn transfer by movement of the entire cam box that houses the traversing mechanism. This type of mechanism involves the axial displacement of large mass leading to complex, expensive device. Therefore, there is a need to provide simpler, reliable mechanism of introducing advancing yarn into a grasping device during the bobbin changeover operation in automatic winder.

OBJECTS AND ADVANTAGES OF THE INVENTION

Accordingly, one object of the invention is to provide a device to shift the advancing yarn from the yarn guide and to introduce the advancing yarn to a grasping device.

A further object of the present invention is to provide a device to return the advancing yarn, after yarn has been grasped in the grasping device, to the traverse guide.

Another object of the present invention is to provide a simple mechanism to achieve the movement of the yarn to the grasping device and to return yarn back into the traverse guide without any axial displacement of spindle or traverse housing.

Yet another object of this present invention is to provide a yarn shift and yarn return device that is independent of the yarn grasping device.

SUMMARY OF THE INVENTION

The present invention comprises a traverse guide of a novel design and construction and a transfer link that together transfer the advancing yarn to a grasping device and, once it has been grasped, back to the traverse guide. The transfer link shifts the advancing yarn from the traverse guide while still positioning the yarn within a virtual controlled zone within which the yarn stays until it is grasped by the grasping device, where after, during the return stroke of transfer link, the advancing yarn is placed back into the traverse guide so that yarn can be uniformly wound on the bobbin.

Accordingly, the present invention provides a device for introducing advancing yarn to the grasping device of an automatic turret type winder, said device comprises a traverse guide and a transfer link, wherein said traverse guide is characterized by at least an outer wing that is provided on the grasping-device-side of the groove of said traverse guide, and wherein said transfer link is characterized by its hook, and further wherein said traverse guide and said transfer link are positioned relatively to each other by positioning said traverse guide along the cam box at a predetermined location, preferably at the end of the traverse stroke, and by rotatably connecting said transfer link to a suitable part of the winder to allow the rotational movement of said transfer link in its own plane, so that the process of yarn movement from said traverse guide to the grasping device and back to said traverse guide is made through the rotational movement of the transfer link, such that said advancing yarn always remains secured by said outer wing and said hook.

Preferably, said transfer link is rotatably connected to a suitable part of the winder, preferably at the end of a cam box or a traverse box such that said transfer link, during its rotational movement towards said grasping device, picks up said advancing yarn from said traverse guide.

Preferably, said traverse guide is further characterized in that said wings of said traverse guide are positioned such that the inclusion angle of said wings is in a range that said transfer link, during the yarn return phase, easily places the returning yarn on the wing of said traverse guide, preferably onto said outer wing.

More, preferably, said traverse guide is further characterized in that said inclusion angle is in the range between 10° to 270°, more preferably between 60° to 170°, even more preferably between 120° to 160°, and in that when said inclusion angle exceeds 180°, each of said wings is provided with a restricting arm.

In a preferred feature, said transfer link is further characterized in that the profile of said hook shape comprises a transfer part and a return part, such that said advancing yarn remains secured within said hook shape throughout the process of transferring said advancing yarn to said grasping device and back into said traverse guide.

In a preferred feature, said transfer link is further characterized in that the restricting edge that forms a part of said transfer part, is of any shape that allows a jerk-free operation of transfer of said yarn to said grasping device, preferably a shape dial forms a notch and a convex restricting edge, and in that the return edge that forms a part of said return part, is of any shape that allows a jerk-free operation of returning the yarn to said traverse guide, preferably a notch and a convex edge.

In a preferred feature, all edges of said traverse guide and said transfer link that come in contact with said advancing yarn are smooth and blunt.

In a preferred feature, a restricting arm is provided on the wing, preferably at its tip, in the case when said inclusion angle is 180° or greater.

In a preferred feature, the length of the two wings is unequal. In a further preferred feature, the lateral angles of the two said wings are unequal.

BRIEF DESCRIPTION OF THE ACCOMPANYING DRAWINGS

FIG. 1: A typical turret type automatic yarn winder

Figure 2:
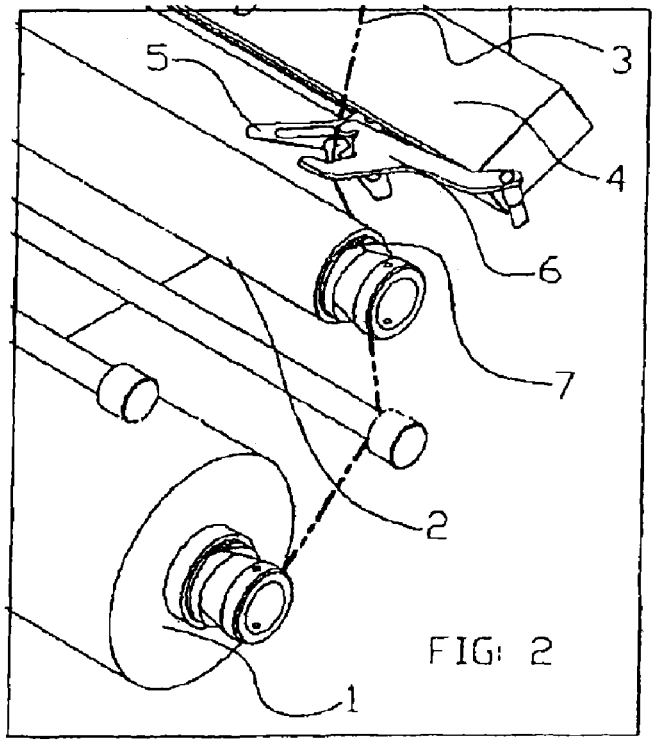

FIG. 2: Empty bobbin positioned for winding

Figure 3:
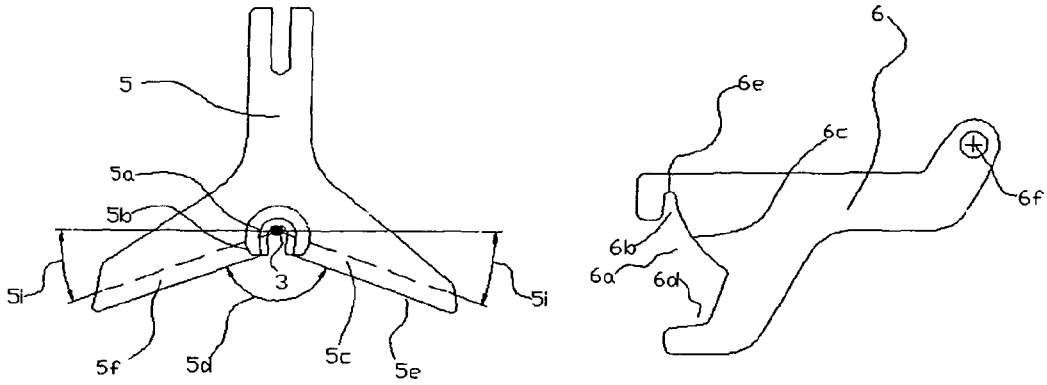

FIG. 3: Preferred profiles of the transfer link hook and the transfer guide

Figure 3A:
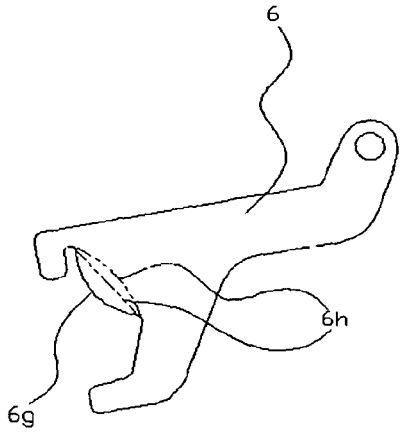

FIG. 3A: Alternative profiles for the transfer link hook

Figure 4:
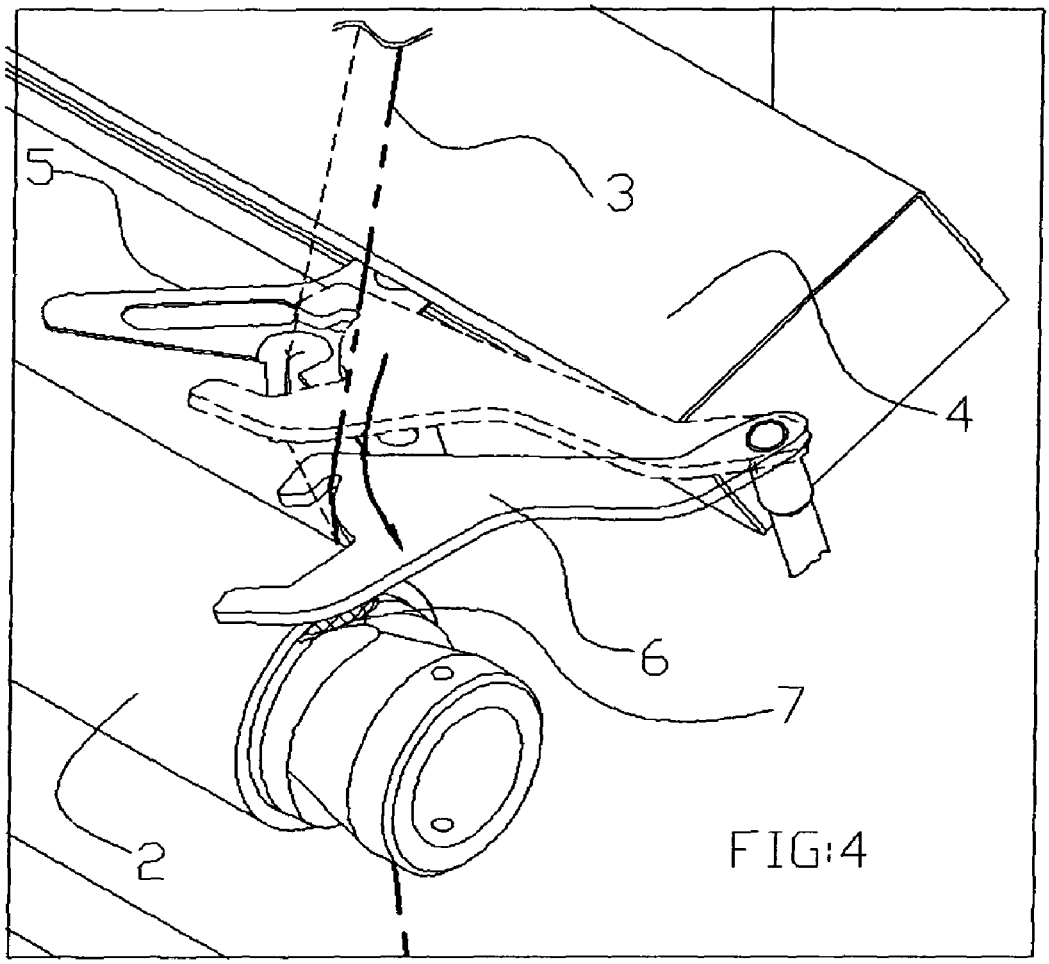

FIG. 4: Transfer link pulls the advancing yarn away from the traverse guide

Figure 5:
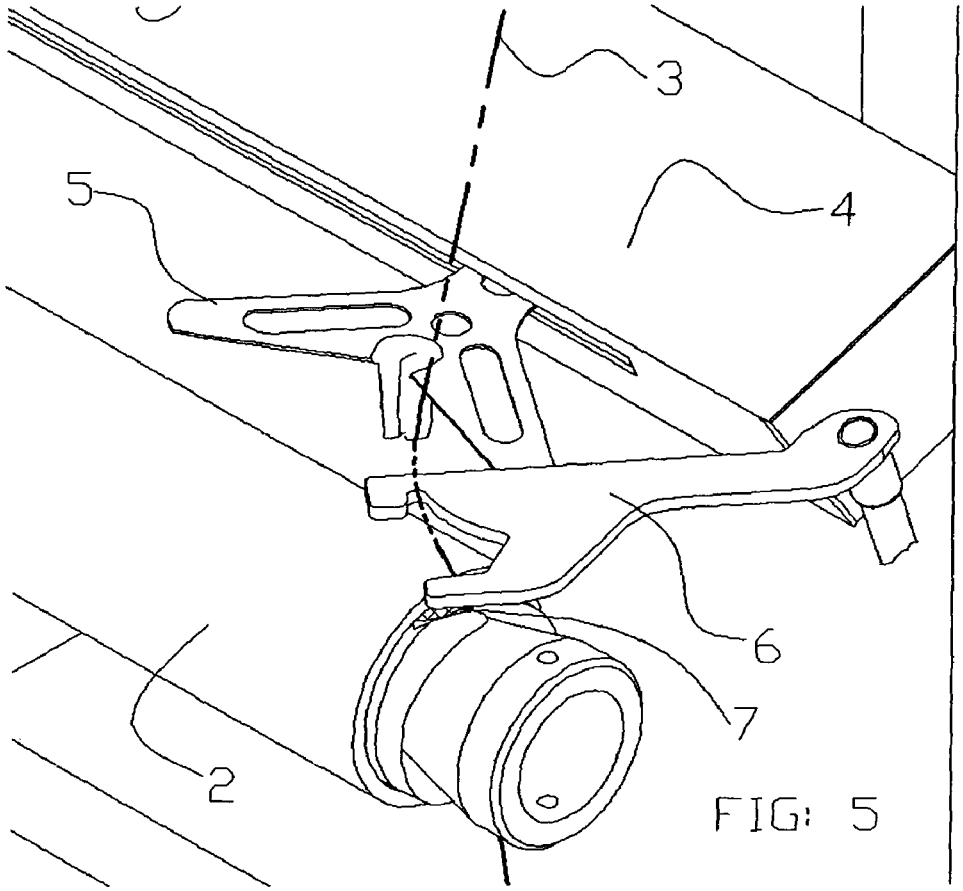

FIG. 5: Transfer link places the advancing yarn into the grasping device

Figure 6:
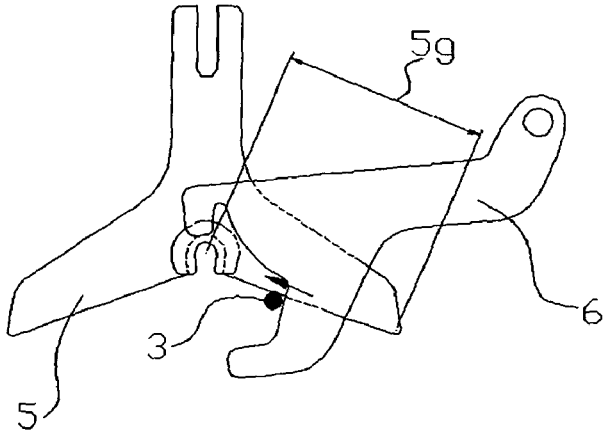
Figure 7:
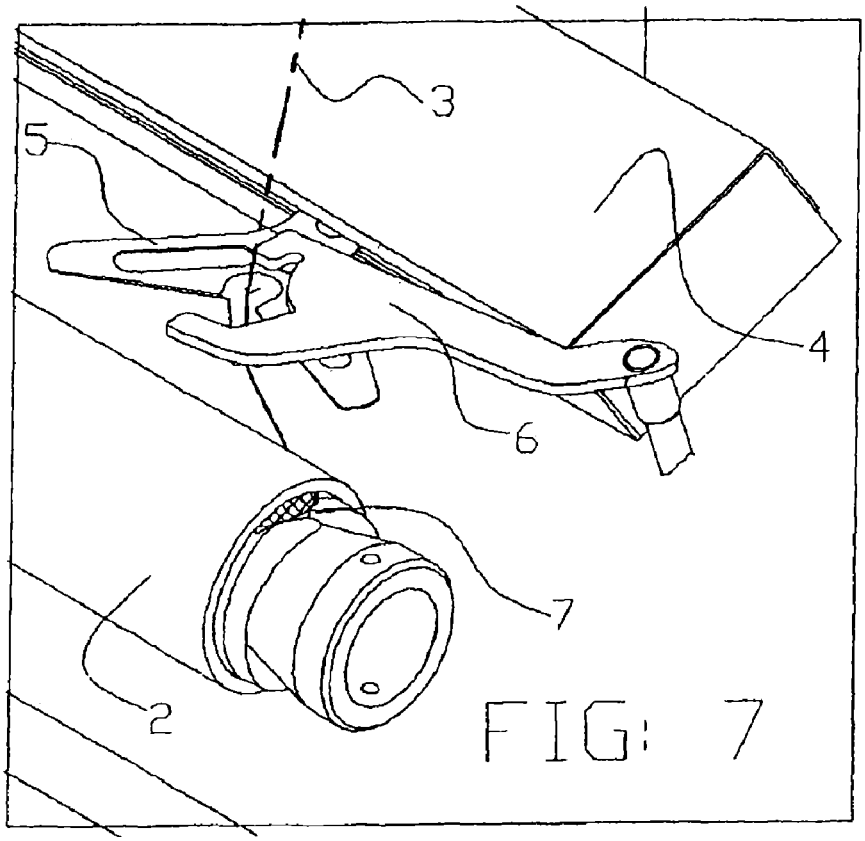

FIG. 6: Transfer link delivers the yarn onto the wings of the traverse guide FIG. 7: The advancing yarn engages back into the traverse guide FIG. 8: Conventional traverse guides FIG. 9: Preferred shape of the traverse guide for single yarn FIG. 9A: Alternative shapes of the traverse guide for single yarn FIG. 10: Relative positions of the transfer link and the traverse guide during the yarn shift to grasping device

LIST OF PARTS

1. Full bobbin
2. Empty bobbin
3. Advancing yarn
4. Cam box
5. Traverse guide; groove (5*a*), ceramic element (5*b*), outer wing (5*c*), inclusion angle (5*d*), inner profile (5*e*), inner wing (50*f*), delivery zone (5*g*), restricting arm (5*h*), lateral angle (5*i*)
6. Transfer link, hook (6*a*), transfer part (6*b*), restricting edge (6*c*) return part (6*d*), the notch (6*e*), mounting axis (60*f*), preferred profile of restricting edge (6*g*), alternative profiles of restricting edge (6*h*)
7. Grasping device
8. Spindle
9. The limit of the lateral movement of the yarn
10. The limit of the catchment span

DETAILED DESCRIPTION OF THE INVENTION

FIG. 1 shows a typical turret type yarn winder in which yarn is wound on bobbins to form suitable packages. FIG. 2 shows a bobbin that is fully wound to its predetermined package size and an empty bobbin (2) that is ready for winding. The device of the present invention essentially comprises a novel traverse guide (5) and a transfer link (6) that work together in a unique way. In its yarn shift phase, the device shifts the advancing yarn (3) from the traverse guide (5) towards the grasping device (7) that is typically provided at the end of the bobbin, or alternatively at the end of spindle (8) on which a bobbin is mounted. Once the yarn is grasped by the grasping device (7), the device of the present invention, in what is termed as the yarn return phase, returns the yarn to the traverse guide (5) so that the winding of the advancing yarn (3) can begin on the empty bobbin (2).

A cam box (4) or a similar traversing arrangement houses the traverse guide (5) of the present invention. As shown in FIG. 3, the traverse guide (5) has at least one groove (5*a*) to guide advancing yarn (3). The groove (5*a*) is optionally fitted with a ceramic element (5*b*) through which the advancing yarn (3) passes.

As shown in FIG. 2, a transfer link (6) element is provided, typically attached to any appropriate part on winder, preferably near the cam box (4) or the traverse box housing, to guide the advancing yarn (3) towards the grasping device (7) that is provided on the bobbin or on the spindle (8). The transfer link (6) is mounted so that it can freely rotate about the axis of mounting (6*f*) like a hinge (see FIG. 2). One of the key features of the present inventions is that the transfer link (6) is provided with a hook-shaped profile (see FIG. 3) such that the transfer link (6):

a). picks up the yarn (3) from the traverse guide (5) effectively, and b). after the pick up of the yarn (3) from the traverse guide (5), the yarn (3) does not slip out of the transfer link's (6) control throughout the yarn transfer operation.

Yarn shift phase: When a bobbin that is being wound on the winder attains its predetermined package size, the turret rotates such that the full bobbin (1) moves away from the cam box (4) and the empty bobbin (2) is positioned in the path of advancing yarn (3). Next, the traverse guide (5) moves to its extreme position near the bobbin-end fitted with the grasping device (7) and comes to a standstill state at a position detected by a suitable sensor, the preferable position being the end of the traverse stroke. The transfer link (6) rotates about mounting axis (6*f*) in suitable direction to collect the advancing yarn (3) in the hook (6*a*) (see FIG. 4). As shown in FIG. 5, the transfer link (6) continues its rotation away from the traverse guide (5), to carry the advancing yarn (3) away from the winding zone towards the grasping device (7). The grasping device (7) grasps the introduced advancing yarn (3).

It is important that the movement of the transfer link (6) and consequently that of the advancing yarn (3) remains jerk-free during the yarn shifting phase of the yarn transfer operation. The profile of the hook (6*a*) (see FIG. 3) is of particular relevance in this respect. The hook (6*a*) has two prominent parts—a transfer part (6*b*) that ensures secure transfer of the yarn to the grasping device (7), a return part (6*d*) that ensures return of the advancing yarn (3) to the traverse guide (5). The preferred profile of transfer part (6*b*) includes a convex shaped (see FIG. 3) restricting edge (6*c*) such that preferably a notch (6*e*) is formed at the yarn picking end of the hook (6*a*). As shown in FIG. 3A the novel profile (6*g*) of the restricting edge (6*c*) ensures that the yarn (3) is securely restricted to the notch (6*e*) during the yarn's movement from the traverse guide (5) to the grasping device (7) so that the yarn does not jerk about during this movement. Alternatively, any other shape that would achieve the jerk-free movement of the yarn may be provided to the transfer part (6*b*) (see parts no. 6*h* of FIG. 3A). The speed of the angular movement of the transfer link (6) is maintained under control by any suitable mechanism, typically like electro-pneumatic mechanism such that angular movement of transfer link (6) is not too slow to form uneven winding in yarn package or too fast to break the yarn or cause jerk.

Figure 8:
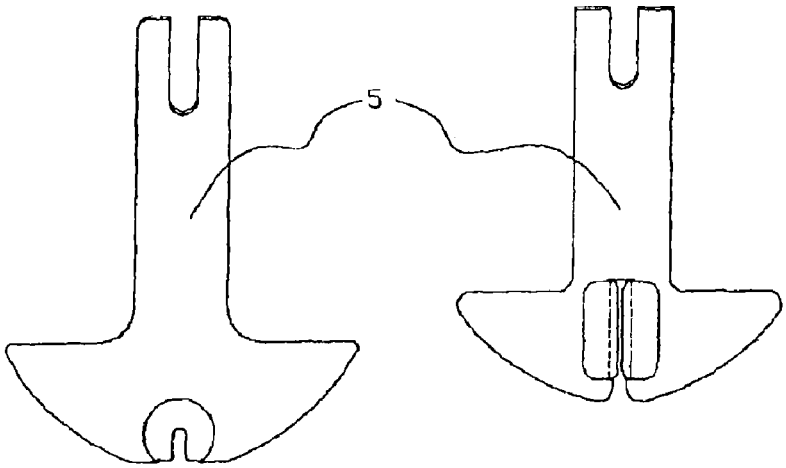
FIG 8 Prior Art

Yarn return phase: Once the yarn (3) has been grasped by the grasping device (7), the transfer link (6), with the advancing yarn (3) still within its hook (6*a*), rotates towards the traverse guide (5) and with the yarn (3) controlled by the return part (6*d*) shifts the yarn onto the delivery zone (5*g*) of preferably the outer wing (5*c*) of the traverse guide (5) (FIG. 6 indicates, by a thick arrow, the yarn movement over the outer wing (5*c*) towards the groove). Under the effect of the continued tension in the yarn (3), and the novel shape of the traverse guide (5) that partly characterizes the invention, the yarn (3) finds it way back into the groove of the traverse guide (5) or the optional ceramic element (5*b*) that is provided within the groove (5*a*) (see FIG. 7). The conventional traverse guides are shown in FIG. 8. The conventional traverse guides are typically small in size so that when the transfer link (6) or a similar device returns the advancing yarn (3), after being grasped, to the traverse guides, the positional synchronization between the various parts of the machinery becomes quite critical.

Figure 9:
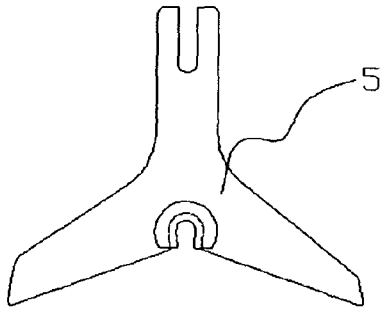
Figure 9A:
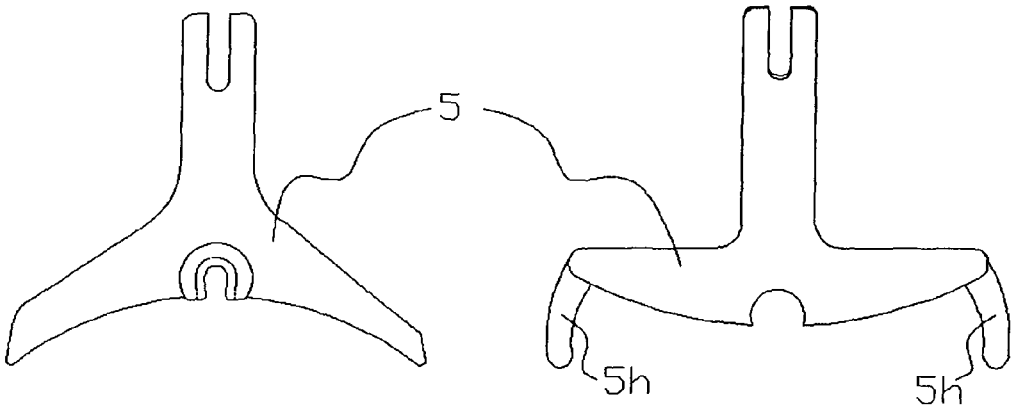

The preferred construction of the traverse guide (5) of the present invention is shown in FIG. 9. The novel construction of the traverse guide (5) of the present invention is such that it has a large catchment span to accept the advancing yarn (3) returned to it by the transfer link (6). In the preferred embodiment of the present invention, the traverse guide (5) has a yarn groove (5*a*) in the middle portion. The catchment span is in the form of wide open wings (5*c* and 5*f*) that flank the groove and which are provided at an inclusion angle (5*d*) as shown in FIG. 9. The wing angle (5*d*) is between 10° to 270°, more preferably 60° to 170°, even more preferably 120° to 160°. Further, when the wing angle (5*d*) is more than 180°, wings are provided with restricted arm as shown in FIG. 9A. The wing arms have preferably equal length, however wings of unequal lengths are found to work satisfactorily.

One other key feature of the present invention is that the large wing span of the traverse guide (5), formed by the wide open wings (5*c* and 5*f*), allows the transfer link (6) to deliver the grasped yarn anywhere on the outer wing (5*c*) (see FIG. 6) rather than in the very close vicinity of the traverse guide groove (5*a*), as is the case with existing known traverse guides. Consequently, the advantage of the present invention is that the positional synchronization between the movements of traverse guide, transfer device and other relevant automatic winder parts becomes either irrelevant or unimportant and invented device performs with more reliability.

The wings of the traverse guide (5) are alternatively provided in a concave inner profile (5*e*) (see FIG. 9A). However, it is found by the inventors that other embodiments of the inventions that include other profiles (for example, convex), also as depicted in FIG. 9A, will also allow the invention to operate satisfactorily. In case of the convex profiles, a restricting arm (5*h*) is added on the wings at a suitable location, preferably at the tips of the wings. The lengths of the wings and the angle (5*d*) between the internal edges of the wings are designed so that the returning yarn always falls on the wings, where after, under the continued tension in the advancing yarn (3), it returns to the guide groove (5*a*). The profile of the wings and that of the hook (6*a*) of the transfer link (6) is smoothened so that the movement of the yarn along these edges is swift and unhindered, thereby reducing the possibility of the yarn breakage.

Figure 10:
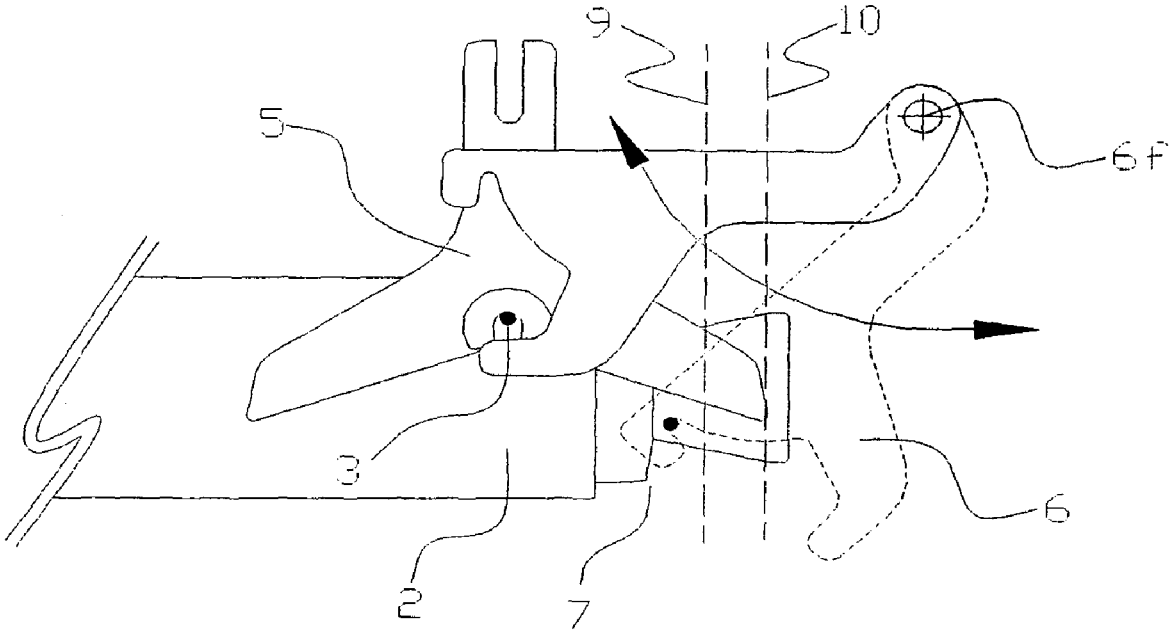

As shown in FIG. 10, another characteristic feature of the present invention is that the advancing yarn (3) always remains within the catchment span of the traverse guide. The figure shows the limit of the lateral movement (9) of the yarn and the limit of the catchment span (10) for the outer wing. It is evident that for the maximum movement of the transfer link, the yarn is still positioned so that, particularly in case of yarn slipping out of the control of a transfer link, the yarn will be caught within the catchment span, thereby leading back to the groove, rather than getting entangled in other parts of the winder.

It is crucial for advancing yarn (3), after been grasped in yarn transfer process, the advancing yarn (3) is returned to the traverse guide groove (5*a*) swiftly and in the first attempt so that the yarn transfer from the full bobbin (1) to empty bobbin (2) can take place without glitches. The specially designed winged shape of the traverse guide (5) and the hooked shape of the transfer link (6) are crucial for the invention to work to achieve the above said effect. A failure to do so may cause interruption in the yarn winding process, leading to yarn wastage.

In a further embodiment the internal profile of the hook (6*a*) of the transfer link (6) may assume any profile that carries out the transfer operation effectively. Typical profiles have been shown in FIG. 3*a*.

In one embodiment of the present invention, wing may be provided on only one side of the groove on the grasping-device-side of the groove.

In another embodiment of the present invention, said wings are positioned at unequal lateral angles.

While the above description contains many specificities, these should not be construed as limitation in the scope of the invention, but rather as an exemplification of the preferred embodiments thereof. Many other variations are possible. Accordingly, the scope of the invention should be determined not by the embodiments illustrated, but by the appended claims and their legal equivalents.

I claim:

1. A device for introducing advancing yarn to a grasping device of an automatic turret winder, said device comprises a traverse guide and a transfer link, characterised in that wherein said traverse guide comprises at least an outer wing that is provided on a groove of said traverse guide, and wherein said transfer link has a hook, and further wherein said traverse guide and said transfer link are positioned relative relatively to each other by positioning said traverse guide along a cam box at a predetermined location and by rotatably connecting said transfer link to a suitable part of the winder to allow the rotational movement of said transfer link in a plane of said transfer link, so that the process of yarn movement from said traverse guide to the grasping device and back to said traverse guide is made through the rotational movement of the transfer link, such that said advancing yarn generally remains secured by said outer wing and said hook.

2. The device according to claim 1, wherein said transfer link is rotatably connected to a suitable part of the winder during rotational movement of the transfer link towards said grasping device and picks up said advancing yarn from said traverse guide.

3. The device according to claim 2, wherein said transfer link is rotatably connected to a suitable part of said winder at an end of said cam box or a traverse box.

4. The device according to claim 1, wherein said traverse guide is further characterized in that said outer wing and an inner wing of said traverse guide are positioned such that an inclusion angle of said outer and inner wings is in a range that said transfer link, during the yarn return phase, places the returning yarn on said outer wing or said inner wing of said traverse guide.

5. The device according to claim 4, wherein length of the two wings is unequal.

6. The device according to claim 4, wherein lateral angles of the two said wings are unequal.

7. The device according to claim 1, wherein said traverse guide is further characterized in that an inclusion angle is in a range between 10° to 270°, and in that when said inclusion angle exceeds 180°, each of said outer and inner wings is provided with a restricting arm.

8. The device according to claim 7, wherein the restricting arm is provided on each of the outer and inner wings, in the case when said inclusion angle is 180° or greater.

9. The device as claimed in claim 8, wherein said restricting arm is provided at a tip of said inner and outer wings.

10. The device as claimed in claim 7, wherein the inclusion angle is in a range between 60° to 170°.

11. The device as claimed in claim 7, wherein the inclusion angle is in a range between 120° to 160°.

12. The device according to claim 1, wherein said transfer link is further characterized in that the profile of a hook shape of said hook comprises a transfer part and a return part, such that said advancing yarn remains secured within said hook shape throughout the process of transferring said advancing yarn to said grasping device and back into said traverse guide.

13. The device according to claim 12 wherein said transfer link is further characterized in that a restricting edge that forms a part of said transfer part, is of any shape that allows a generally jerk-free operation of transfer of said yarn to said grasping device and in that a return edge that forms a part of said return part, is of any shape that allows a generally jerk-free operation of returning the yarn to said traverse guide.

14. The device according to claim 13 wherein all edges of said traverse guide and said transfer link that come in contact with said advancing yarn are generally smooth and blunt.

15. The device as claimed in claim 13 wherein said restricting edge is of a shape that forms a notch and a convex restricting edge.

16. The device as claimed in claim 13 wherein said return edge comprises a notch and a convex edge.

17. The device according to claim 1, wherein said traverse guide and said transfer link are positioned relatively to each other by positioning said traverse guide along said cam box at an end of a traverse stroke.

* * * * *

UNITED STATES PATENT AND TRADEMARK OFFICE

CERTIFICATE OF CORRECTION

PATENT NO. : 8,267,342 B2
APPLICATION NO. : 12/449702
DATED : September 18, 2012
INVENTOR(S) : Amit Kumar Lohla It is certified that error appears in the above-identified patent and that said Letters Patent is hereby corrected as shown below:

In the Claims

Column 6, line 57, delete "relatively"

Signed and Sealed this
Nineteenth Day of August, 2014

Michelle K. Lee

Michelle K. Lee
*Deputy Director of the United States Patent and Trademark Office*